US009070978B2

(12) United States Patent
Boni et al.

(10) Patent No.: US 9,070,978 B2
(45) Date of Patent: Jun. 30, 2015

(54) DIPOLE ANTENNA FOR SAFETY HELMETS

(71) Applicant: NOLANGROUP S.p.A., Brembate di Sopra (BG) (IT)

(72) Inventors: Angelo Boni, Reggio Emilia (IT); Marco Mazzali, Rio Saliceto (IT)

(73) Assignee: NOLANGROUP S.P.A., Brembate di Sopra (BG) (IT)

( * ) Notice: Subject to any disclaimer, the term of this patent is extended or adjusted under 35 U.S.C. 154(b) by 222 days.

(21) Appl. No.: 13/725,511

(22) Filed: Dec. 21, 2012

(65) Prior Publication Data

US 2013/0176183 A1 Jul. 11, 2013

(30) Foreign Application Priority Data

Jan. 5, 2012 (IT) ..... MI2012A0011

(51) Int. Cl.

| | |
|---|---|
| ***H01Q 1/27*** | (2006.01) |
| ***A42B 3/30*** | (2006.01) |
| ***H01Q 1/32*** | (2006.01) |
| ***H01Q 9/26*** | (2006.01) |
| ***H01Q 21/00*** | (2006.01) |
| ***H01Q 21/20*** | (2006.01) |

(52) U.S. Cl.

CPC *H01Q 1/276* (2013.01); *A42B 3/30* (2013.01); *H01Q 1/32* (2013.01); *H01Q 9/26* (2013.01); *H01Q 21/0006* (2013.01); *H01Q 21/205* (2013.01)

(58) Field of Classification Search

CPC ..... H01Q 1/276; H01Q 9/16; H01Q 9/20; H01Q 9/26; H01Q 21/10; H01Q 21/062

USPC ..... 343/793, 801, 813, 718, 720

See application file for complete search history.

(56) References Cited

U.S. PATENT DOCUMENTS

| | | | |
|---|---|---|---|
| 2,904,645 | A | 9/1959 | Sarles |
| 3,016,536 | A | 1/1962 | Fubini |
| 3,680,147 | A | 7/1972 | Redlich |

(Continued)

FOREIGN PATENT DOCUMENTS

| | | |
|---|---|---|
| EP | 0285743 | 10/1988 |
| EP | 1353403 | 10/2003 |

(Continued)

OTHER PUBLICATIONS

Rothammel: "Antennenbuch"; Antennenbuch, XX, XX; Jan. 1, 1988; pp. 195-197, XP000962076.

(Continued)

*Primary Examiner* — Hoang V Nguyen

(74) *Attorney, Agent, or Firm* — Lucas & Mercanti, LLP

(57) ABSTRACT

Substantially-linear dipole antenna for safety helmets, of the type comprising two conductive branches arranged to be electrically connected, at one of their ends, to respective radio equipment, the two conductive branches being disposed substantially aligned. The two conductive branches have a length essentially equal to ¼ of the expected operative wavelength of the radio equipment. The dipole antenna further comprises at least two conductive arms, each having a length essentially equal to ½ of said operative wavelength, each of which is electrically connected respectively to the free end of both of the two conductive branches, both having a length essentially equal to ¼ of the operative wavelength.

14 Claims, 3 Drawing Sheets

(56) References Cited

U.S. PATENT DOCUMENTS 4,833,726 A * 5/1989 Shinoda et al. ..... 455/90.3
7,750,860 B2 * 7/2010 Mohamadi ..... 343/718

FOREIGN PATENT DOCUMENTS

JP 59193605 11/1984
JP 2010124194 6/2010

OTHER PUBLICATIONS

Search Report issued to Italian Application No. MI2012000011, cited for priority in the pending application.

* cited by examiner

DIPOLE ANTENNA FOR SAFETY HELMETS

CROSS-REFERENCE TO RELATED APPLICATION

This Application claims the benefit of priority from Italian Patent Application No. MI2012A000011, filed Jan. 5, 2012, the contents of which are incorporated herein by reference.

FIELD OF THE INVENTION

The present invention relates to a substantially-linear dipole antenna for safety helmets, and in particular for safety helmets for motorcycle use, of the type comprising at least two electrically conductive branches having length substantially equal to ¼ of the expected operative wavelength, disposed so that to be almost mutually aligned, and electrically connected, at one end thereof, to a respective radio equipment by means of at least one coaxial cable.

BACKGROUND OF THE INVENTION

It is known in the art to realize dipole antennas of the substantially-linear half-wave linear type, that is to say composed of two wire-shaped aligned branches, preferably axially disposed, in electrically conductive material whose whole length is equal to ½ of the wavelength to be received or transmitted, adapted to be housed inside a safety helmet to thus allow the radio signal reception or transmission by a radio equipment, the latter being arranged too inside the safety helmet.

As it is well known, the use of a substantially-linear dipole antenna for the transmission and reception of radio signals in a safety helmet is particularly popular for the optimal omnidirectionality features shown by such type of antennas, and for their constructive easiness, and finally for the sizes of such antennas which, in the bandwidth (2.4-2.5 GHz) commonly used in the vehicular radio transmissions, are particularly reduced and therefore easily adaptable to the shape of the helmet outer cap.

However, just their reduced sizes, on the order of 3 cm for each branch composing the dipole antenna in the case of 2.4-2.5 GHz frequencies, and their arrangement inside the cap in a central region thereof, so that asymmetries in the reception/transmission of radio signals do not occur, cause such antennas to exhibit a reduced reception/transmission area (range), due to the interference of the user head and neck, when the helmet is correctly worn.

It is in fact well known that at typical operative frequencies of the vehicular transmissions, such as for example those of "Bluetooth" radio standard equal to about 2.45 GHz, the maximum signal absorption at such frequency band is given by water and therefore by the human body.

Note as well that the position of such type of substantially-linear half-wave dipole antenna in a safety helmet, for example for motorcyclists, is usually limited to a central, back and bottom region of the helmet outer cap, between such outer cap and the shell thereof made in shock-absorber material, both for constructive convenience reasons, and for bulk reasons.

In such a specific position, the signal absorption at the frequency band comprised between 2.4 and 2.5 GHz by the human body, and in particular by the user head and neck, is particularly significant and can reduce the range of the antenna from half of its theoretical range to one third of such a range.

SUMMARY OF THE INVENTION

It is therefore object of the present invention to realize a substantially-linear dipole antenna for safety helmets which is free from the above mentioned drawbacks of the known art and thus has a high operative range also when the radio signal is comprised in the 2.4-2.5 GHz band.

It is another object of the present invention to realize a substantially-linear dipole antenna for safety helmets which has a substantial omnidirectionality, a wide operative range, as stated, and which could be easily installed under the outer cap of a safety helmet.

It is a further object of the present invention to realize a safety helmet comprising an outer cap enclosing at least one shock absorbing shell and means for coupling the outer cap with a substantially-linear dipole antenna, being easy to realize and allowing an effective radio signal transmission and reception by the afore said dipole antenna.

These and other objects are achieved by the dipole antenna for safety helmets according to the first independent claim and the following dependent claims and by the safety helmet comprising coupling means for a dipole antenna according to the eleventh claim and the following claims dependent therefrom.

The substantially-linear dipole antenna for safety helmets according to the present invention comprises two conductive branches electrically connected, at an end thereof, to respective radio equipment, which are disposed substantially aligned, and have, each one, a length substantially equal to ¼ of the expected operative wavelength of the radio equipment. Advantageously, the dipole antenna further comprises at least two conductive arms, each one having length essentially equal to ½ of said operative wavelength, and wherein each one of such at least two conductive arms is electrically connected to the free end of a respective branch of the afore said two conductive branches.

The extension of the usual half-wave substantially-linear dipole antenna, with two extensions (arms) having length equal to ½ of the expected operative wavelength and placed respectively at the free ends of the two conductive branches, preferably aligned to the afore said two aligned conductive branches, allows to obtain a dipole antenna with pronounced omnidirectionality characteristics and with a length that is sufficient to surround the user head and neck in order not to be excessively shielded by the latter and therefore have a wide reception/transmission range of radio signals.

According to a preferred aspect of the present invention, the conductive branches, each having a length essentially equal to ½ of the operative wavelength, are electrically connected to the respective ends of the two conductive branches, each one having length essentially equal to ¼ of the operative wavelength, by chokes with a suitable value.

Such a solution allows to avoid improper couplings between the two conductive branches having length essentially equal to ¼ of the antenna wavelength having impedance on the order of tens of Ohms with the two conductive arms having length essentially equal to ½ of the wavelength, at which free ends the impedance can reach thousands of Ohms.

According to another preferred aspect of the present invention, the substantially-linear dipole antenna of the above mentioned type is realized by printing onto the board of a respective printed circuit.

According to a further aspect of the present invention a safety helmet is provided comprising, as known, at least one outer cap enclosing at least one shell made in a shock-absorbing material, and provided as well with means for coupling the outer cap with a substantially-linear dipole antenna of the above mentioned type.

According to a preferred aspect of the present invention, such a safety helmet provides that the afore said coupling means, for example constituted by a suitable seat, are arranged at the bottom, back and central portion of the respective outer cap and are obtained between the outer cap itself and the afore said shell made in shock-absorbing material.

BRIEF DESCRIPTION OF THE DRAWINGS

These and other aspects of the present invention will be more evident for the person skilled in the art due to the following description of a preferred embodiment of this invention, provided by way of example and not of limitation, with the aid of the attached figures, wherein.

DETAILED DESCRIPTION OF THE INVENTION

Figure 1:
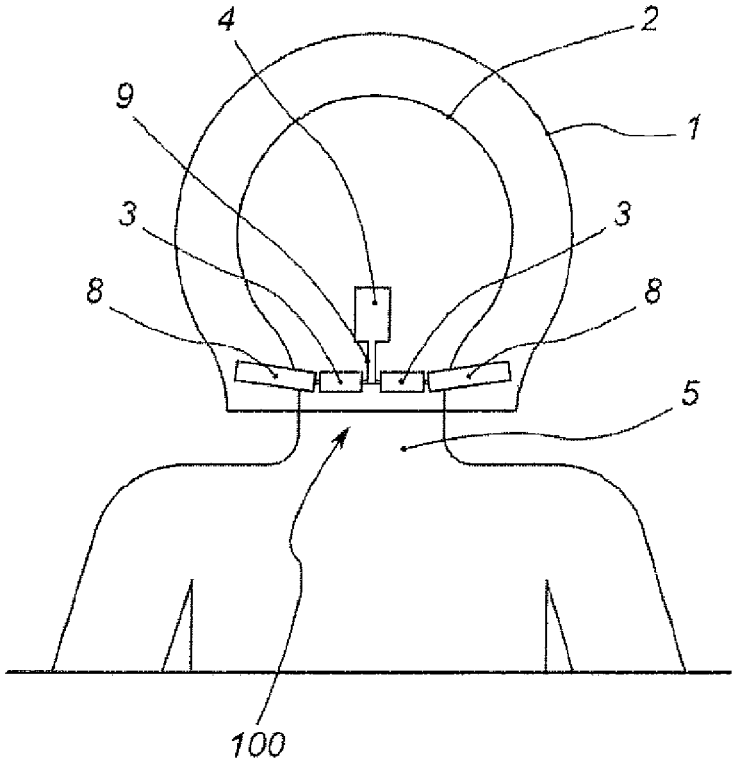
FIG. 1 is a schematic back view of a safety helmet provided with a substantially-linear dipole antenna according to a preferred aspect of the present invention.
Figure 2:
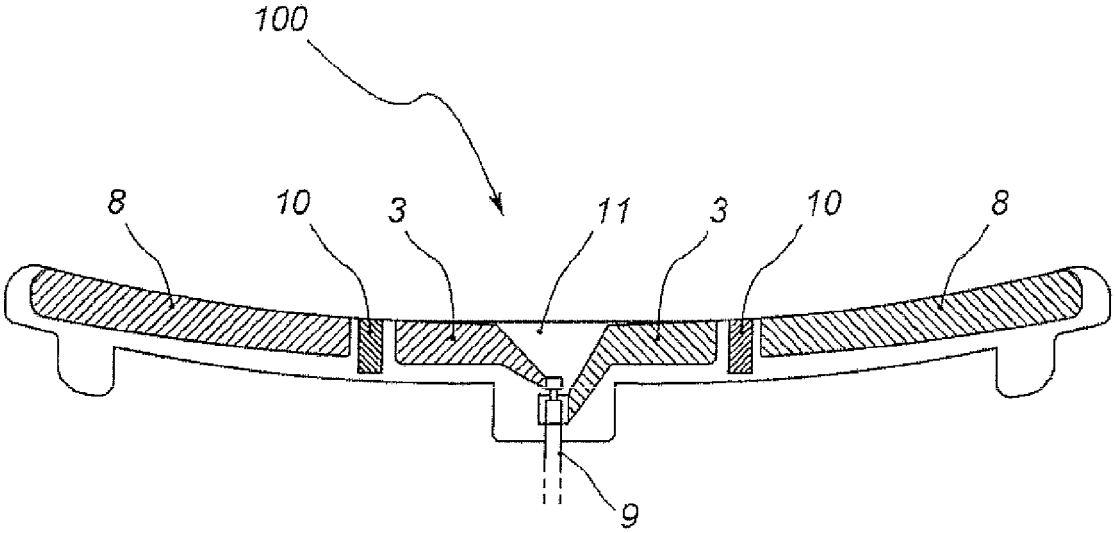
FIG. 2 is a schematic side view of a substantially-linear dipole antenna according to a preferred aspect of the present invention.

Referring first to FIGS. 1 and 2, according to a particular aspect of the present invention, in general with numeral reference 100 a substantially-linear dipole antenna is indicated, that is shaped to be coupled to a safety helmet 1, for example a safety helmet for motorcyclists.

Such a dipole antenna 100, in the particular embodiment of the present invention herein shown, is operatively connected in a way known in the art, by means of a coaxial cable 9, to a radio transceiving equipment 4, such as for example a radio equipment meeting "Bluetooth" standard, and it is constrained as well to the safety helmet 1 at a bottom end in the back region of the outer cap 12 of the same safety helmet 1.

The dipole antenna 100, therefore, when coupled to the safety helmet 1 as in FIG. 1, extends in proximity of the user nape, between the head 2 and neck 5 of the latter.

The constraint between dipole antenna 100 and safety helmet 1, as it will be disclosed more in detail in the following, can be of removable type and can provide that the antenna 100 is arranged under the outer cap 12 of the helmet 1 (see also FIGS. 3 and 4), so that such antenna 100 is protected by the same outer cap 12. Note on the other hand that any other type of constraint between antenna 100 and safety helmet 1 is intended to fall within the scope of protection required by the following claims.

The dipole antenna 100, according to a preferred aspect of the present invention, is of a substantially-linear type, that is to say it develops, by means of conductors having a predominant dimension with respect to the other two, along substantially a continuous line perpendicular to the power supply (i.e. the coaxial cable 9), and it comprises two conductive branches 3, connectable at one end thereof to the afore said coaxial cable 9 of the radio equipment 4, each of which having a length equal to ¼ of the expected working wavelength (in symbols: $\lambda/4$, wherein with the $\lambda$ symbol the expected operative wavelength of the dipole antenna 100 is meant) of the antenna 100.

Such conductive branches 3 of the dipole antenna 100, which as mentioned have length equal to $\lambda/4$ greater than their relative thickness and width, are further arranged substantially along a straight line or a curved line, for example with high curvature radius, so that their total extension, meaning their predominant size, has a length equal to ½ of the expected operative wavelength (i.e. $\lambda/2$) of the dipole antenna 100.

Note that any other arrangement of the two conductive branches 3 along a line in the space allowing such conductive branches 3 to have total extent equal to $\lambda/2$, despite preferably such branches 3 can be substantially axially arranged, is meant to fall within the herein required scope of protection.

At each free end of the conductive branches 3, according to an advantageous aspect of the present invention, a respective arm 8 is connected, the latter being constituted too by a conductor having a predominant dimension (length) with respect to the other two, and extending preferably, even if not necessarily, in such a way to be aligned to the two conductive branches 3. Each one of such conductive arms 8 advantageously has length equal to ½ of the expected operative wavelength (i.e. it has a length equal to $\lambda/2$) and is electrically connected to the respective branch 3, de facto constituting an extension thereof.

Therefore, in the herein disclosed instance showing a preferred embodiment of the present invention wherein the conductive branches 3 and the respective arms 8 are all mutually aligned along a straight line, or a curved line with high curvature radius (see FIG. 2), the total extent of the dipole antenna 100 is about $3\lambda/2$, that is it has a length about 3/2 of the expected operative wavelength.

In order to avoid an improper and detrimental coupling between the two conductive branches 3, which in the vehicular radio applications can have 50 Ohms impedance at their relevant ends coupling to the coaxial cable 9, and the two respective extending conductive arms 8, at which ends the impedance can be equal to thousands of Ohms, the electrical coupling between each conductive arm 8 and the respective conductive branch 3 is assigned to a choke 10 of suitable value.

According to a preferred aspect of the present invention, both the conductive branches 3 and the conductive arms 8, that extend the conductive branches 3 of the antenna 100, can be substantially wire-shaped conductors.

According to another aspect of the present invention, each of the conductive branches 3 and the extending conductive arms 8, and the inductances 10 of the above described dipole antenna 100, can be realized by directly printing onto a board of a suitable printed circuit 11.

In this latter instance, the printed circuit 11 carrying the dipole antenna 100 can be shaped for easily coupling to the safety helmet 1, and for example can easily take the curvature of the outer cap 12 of the helmet 1, so to be easily constrained to the same cap 12 of the helmet 1, inside the latter.

On the other hand note that in the instance in which the dipole antenna 100 is on the contrary realized separately by means of proper metal conductors and then joined to a respective support, the particular shape of the branches 3 and arms 8, having a predominant size with respect to the others and at most being wire-shaped, a wide discretion about the shape of the above said support is allowed, so that the latter can be easily constrained to the safety helmet 1, and in particular to the outer cap 12 of the latter.

The dipole antenna 100, which as said is intended to be coupled to a safety helmet 1 and is therefore operatively connected to a vehicular radio equipment 4, is so sized as to operate with a frequency band extending around 2.5 GHz and, preferably, set between 2.4 and 2.5 GHz. This involves that the operative wavelength to which the dipole antenna 100 refers can be comprised between 10 and 15 cm and, preferably, is comprised between 12 and 13 cm.

In case of use of the dipole antenna 100 with such wavelengths, as usually occurs in communication devices 101 which are coupled to safety helmets for motorcycle use, it results therefore that the above described dipole antenna 100 has a length substantially comprised between 15 and 22.5 cm, and preferably between 18 and 19.5 cm.

Figure 3:
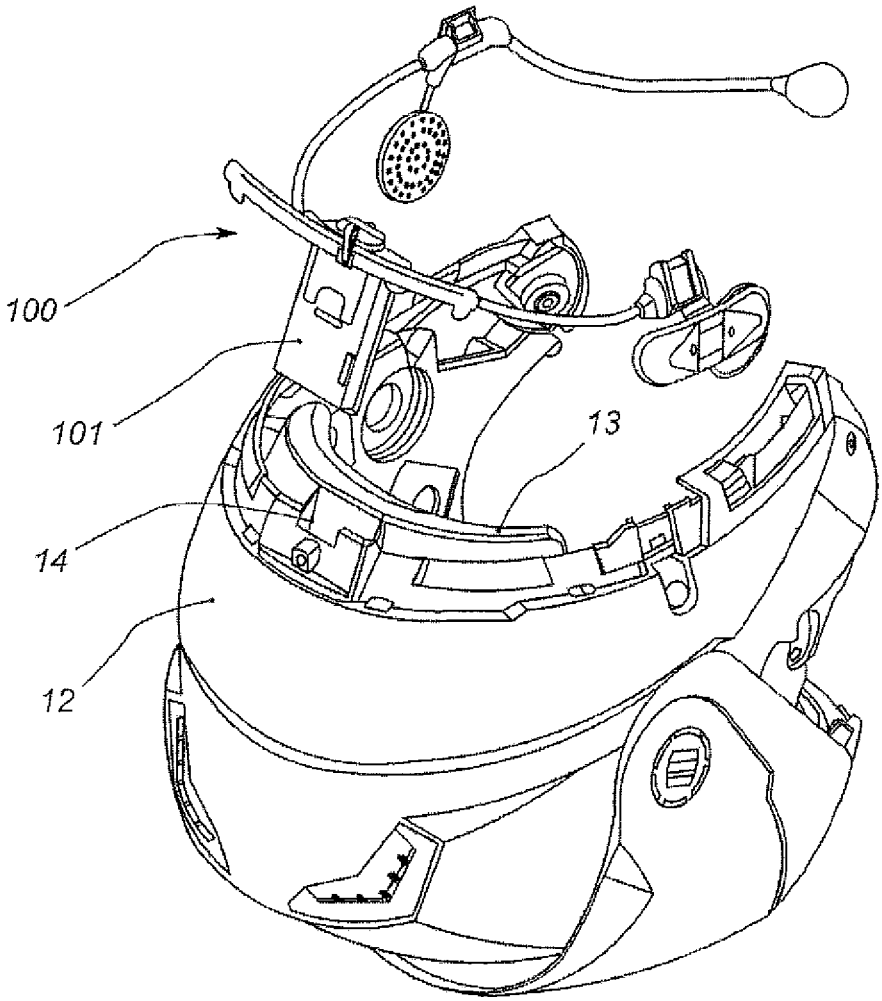
FIG. 3 is a perspective view of a safety helmet and substantially-linear dipole antenna according to an aspect of the present invention, before the dipole antenna is mounted inside the helmet.
Figure 4:
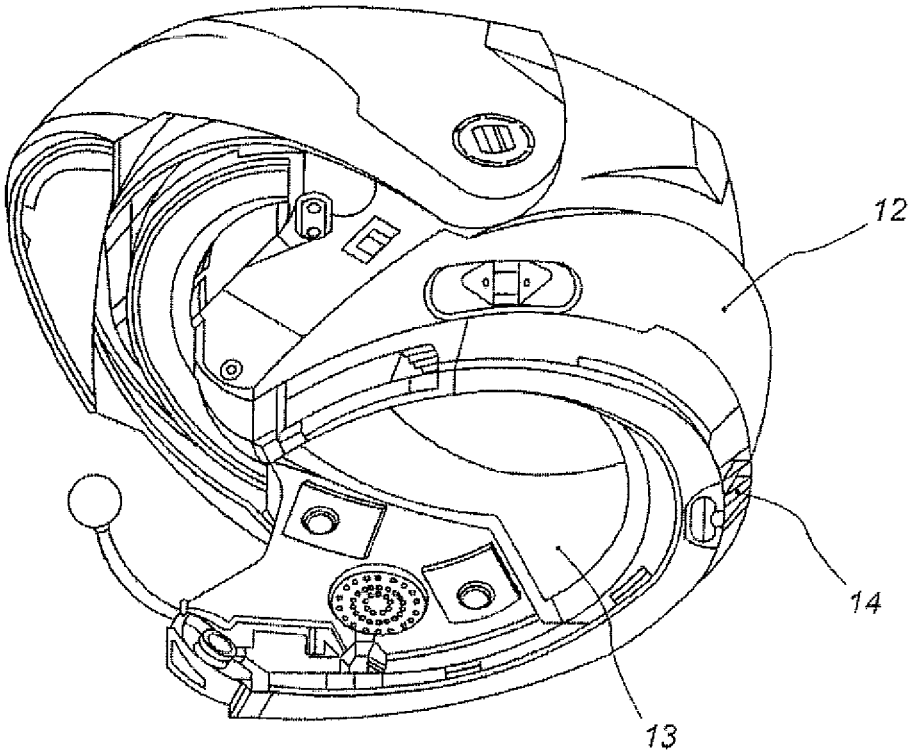
FIG. 4 is a perspective view of the helmet in FIG. 3 with the dipole antenna mounted.

This involves as well that, as it will be understood from the following of this description too, in case wherein the dipole antenna 100 is constrained to the outer cap 12 of the helmet 1 at the user nape, as shown in FIGS. 1, 3 and 4, the extending conductive arms 8 of the dipole antenna 100 extend outside of the region occupied by the user neck 5, i.e. they jut out of the neck 5 so that not to be entirely shielded by the latter.

As the Applicant verified, the particular shape of the above described dipole antenna 100 thus allows a substantial omnidirectionality of the radio signal reception/transmission and at the same time allows to obtain a wide signal range in reception and transmission, since the dipole antenna 100 is only partially shielded, in case of signal reception from the front helmet direction, by the user head 2 and neck 5.

As shown in FIGS. 3 and 4 herein attached, the particular embodiment of the substantially-linear dipole antenna 100, according to the present invention, allows its easy coupling, in conjunction with the respective communication device 101 (of which the radio equipment 4 is a component), with a safety helmet 1, which comprises, as usual, an outer cap 12, for example made of rigid plastic material, such as polycarbonate, or glass or kevlar fiber, an inner shell 13 in a shock-absorbing material, such as for example expanded polystyrene, enclosed by the outer cap 12, and an inner cap, also in plastic material and surrounded at least partly by the shell 13, carrying a soft material layer, such as for example foam rubber, to increase the user comfort.

According to a preferred aspect of the present invention, the safety helmet 1 comprises as well means 14 for coupling the outer cap 12 with the substantially-linear dipole antenna 100, or better with the support of the latter, which in the herein disclosed embodiment comprise a seat 14 arranged between the outer cap 12 and the inner shell 13 made of shock-absorbing material.

Such a seat 14 is arranged at the back region of the outer cap 12 of the safety helmet 1, i.e. that region opposed to the front opening of the helmet 1 itself, in bottom and center position, so that the arms 8 and the branches 3 of the dipole antenna 100 are substantially arranged symmetrically with respect to the axis of the user neck 5 and head 2, so that, as mentioned, the extension arms 8 jut out at least partly from that area of the outer cap 12, and therefore of the helmet 1, closely adjacent to the user neck 5, so that not to be shielded by the latter.

According to a preferred aspect of the present invention, the afore said seat 14 is shaped for housing, at least partly, the afore mentioned printed circuit 11 on which the dipole antenna 100 of the present invention can be advantageously printed.

The invention claimed is:

1. A safety helmet comprising:

at least one outer cap enclosing at least one shell made of a shock-absorbing material; and a coupling means for coupling said outer cap to a substantially-linear dipole antenna, wherein the dipole antenna comprises two conductive branches arranged to be electrically connected, at each one of their ends, to a respective radio equipment, the two conductive branches are disposed substantially aligned and both have a length essentially equal to ¼ of a predefined operative wavelength, the dipole antenna further comprises at least two conductive arms, each having a length essentially equal to ½ of said operative wavelength, and each of said at least two conductive arms is electrically connected respectively to each free end of said two conductive branches.

2. The safety helmet according to claim 1, wherein said coupling means is disposed at bottom, back and central portions of said outer cap.

3. The safety helmet according to claim 1, wherein said coupling means is disposed between said outer cap and said at least one shell.

4. The safety helmet according to claim 1, wherein said coupling means comprises a seat for a printed circuit wherein said two branches and said at least two arms are conductors printed on a board of the printed circuit.

5. The safety helmet according to claim 4, wherein said at least two conductive arms are connected electrically to the respective ends of said two branches by chokes.

6. The safety helmet according to claim 5, wherein said chokes are printed on said board of the printed circuit.

7. The safety helmet according to claim 1, wherein at least part of said at least two arms of the dipole antenna protrude at least partially from an area of said outer cap which is adjacent to a neck of a user.

8. The safety helmet according to claim 1, wherein said at least two conductive arms and said two conductive branches are substantially aligned one another.

9. The safety helmet according to claim 1, wherein said at least two conductive arms and said two conductive branches lie substantially on a curve.

10. The safety helmet according to claim 1, wherein said at least two conductive arms are connected electrically to the respective ends of said two branches by chokes.

11. The safety helmet according to claim 1, wherein said two branches and said at least two arms are substantially wire-shaped conductors.

12. The safety helmet according to claim 1, wherein said predefined operative wavelength is substantially comprised between 10 and 15 cm.

13. The safety helmet according to claim 12, wherein said predefined operative wavelength is substantially comprised between 12 and 13 cm.

14. The safety helmet according to claim 12, wherein the dipole antenna is shaped to be disposed underneath said outer cap of the safety helmet.

* * * * *